US005628615A

United States Patent [19]

Asabuki et al.

[11] Patent Number: 5,628,615

[45] Date of Patent: May 13, 1997

[54] VORTEX FLOW BLOWER AND VANE WHEEL THEREFOR

[75] Inventors: Hiroshi Asabuki; Masayuki Fujio, both of Sakura; Takashi Watanabe, Narita; Susumu Yamazaki, Tsuchiura; Fumiaki Ishida, Narashino, all of Japan

[73] Assignee: Hitachi, Ltd., Tokyo, Japan

[21] Appl. No.: 470,457

[22] Filed: Jun. 6, 1995

Related U.S. Application Data

[62] Division of Ser. No. 200,109, Feb. 22, 1994, Pat. No. 5,487,639.

[30] Foreign Application Priority Data

Feb. 23, 1993 [JP] Japan ..... 5-033516
Mar. 17, 1993 [JP] Japan ..... 5-056718

[51] Int. Cl.[6] ..... F01D 1/12

[52] U.S. Cl. ..... 415/55.1

[58] Field of Search ..... 415/55.1, 55.2, 415/55.3, 55.4, 55.5

[56] References Cited

U.S. PATENT DOCUMENTS 1,973,669 9/1934 Spoor ..... 415/55.1
3,899,266 8/1975 Masai et al. ..... 415/55.1
5,265,996 11/1993 Westhoff et al. ..... 415/55.1
5,487,639 1/1996 Asabuki et al. ..... 415/55.1

FOREIGN PATENT DOCUMENTS 0383238 8/1990 European Pat. Off. .
892498 8/1953 Germany .
3520218 12/1985 Germany .
51-057011 5/1976 Japan .
101122 2/1990 Japan .
217699 6/1992 Japan .

*Primary Examiner*—John T. Kwon
*Attorney, Agent, or Firm*—Antonelli, Terry, Stout & Kraus

[57] ABSTRACT

A vane wheel driven by a shaft for transferring a gas, comprises, vortex flow chambers opening in a direction substantially parallel to the shaft to receive the gas, to urge the gas in a substantially circumferential direction of the vane wheel, and to generate and accelerate a vortex flow of the gas, A vane member includes a hub through which the vane member is connected to the shaft, with the vane member including a plurality of vanes each extending integrally from the hub in a substantially radial direction of the vane wheel. Each of the vanes includes a front surface for urging the gas in the substantially circumferential direction of the vane wheel. A vortex flow chamber wall extends integrally from both the hub and each of the vanes, and a cover contacts the vortex flow chamber wall to form the vortex flow chambers together with the vortex flow chamber wall and the vanes.

7 Claims, 17 Drawing Sheets

VORTEX FLOW BLOWER AND VANE WHEEL THEREFOR

This is a Divisional application of U.S. Ser. No. 08/200,109, filed Feb. 22, 1994, now U.S. Pat. No. 5,487,639.

FIELD OF THE INVENTION

The present invention relates to a vortex flow blower and a vane wheel therefor. Particularly, the present invention is preferable for a vane wheel with three-dimensionally curved vane surfaces.

BACKGROUND OF THE INVENTION

Japanese Unexamined Patent Applications Shou-51-57011 and Hei-2-215997 disclose a vane wheel divided into two independent parts, with the parts being subsequently joined each other. Japanese Unexamined Patent Application Shou-51-57011, proposes a vane wheel dividing line extending perpendicularly to a rotational axis of the vane wheel; Japanese Unexamined Patent Application Hei-2-215997, proposes an arrangement the vane wheel dividing line extends along edges of vanes.

SUMMARY OF THE INVENTION

An object of the present invention is provide a vane wheel which is divided into at least two members for easy production, and whose rigidity, strength and vibration-absorbing-characteristic are high.

According to the present invention, a vortex flow blower for transferring gas comprises a motor having an output rotational shaft and a vane wheel driven by the shaft. The vane wheel includes vortex flow chambers opening in a direction substantially parallel to the output rotational shaft to receive the gas therein, to urge the gas in a substantially circumferential direction of the vane wheel, and to generate and accelerate a vortex flow of gas therein. A vane member includes a hub through which the vane member is connected to the shaft. A plurality of vanes extend integrally or monolithically from the hub in a substantially radial direction of the vane wheel, with each of the vanes including a front surface for urging the gas in a substantially circumferential direction of the vane wheel, and with a vortex flow chamber wall extending integrally of monolithically from both the hub in each of the vanes. A cover means contacts and/or is pressed against the vortex flow chamber wall to form a vortex flow chamber together with the vortex flow chamber wall and the vanes.

Since the vane member includes each of vanes each of extending integrally or continuously from the hub in the substantially radial direction of the vane wheel and the vortex flow chamber wall extending integrally monolithically or continuously from both of the hub and each of the vanes, the vortex flow chamber wall rigidly supports the vanes and the hub. Therefore, although the vane wheel is divided into the vane member and the cover means, the rigidity and strength of the vanes are high. Further, since the cover means contacts with the vortex flow chamber wall, a friction between the cover means and the vortex flow chamber wall, when an adhesive adheres to the cover means and the vortex flow chamber wall so that the cover means contacts with the vortex flow chamber wall through the adhesive, a deformation of the adhesive therebetween, absorbs a vibration of the vane wheel, particularly a vibration generated in the vortex flow chambers. A pressing force between the cover means and the vortex flow chamber wall is increased so as to absorb the vibration. Therefore, although the vane wheel is divided into the vane member and the cover means, the vane wheel is prevented from generating the vibration.

The vortex flow chamber wall may curve to project in the substantially radial and/or circumferential direction of the vane wheel so that a section modulus and a geometrical moment of inertia of an integral or continuous combination of the vortex flow chamber wall and the vanes are remarkably increased, and a contact area between the cover means and the vortex flow chamber wall is increased. Therefore, the rigidity, strength and vibration-absorbing-characteristic are further improved.

It is preferable for each of the vanes to be prevented from being divided. Each of the front surfaces may form an inclined angle relative to an imaginary plane substantially perpendicular to the output rotational shaft, and the angle is less than a right angle. In this case, a casting mold for forming the inclined vanes can be inserted and easily securely supported through a through-holes or notches so that the vane wheel with three-dimensionally curved vane surfaces can be correctly formed. The vortex flow chamber wall may have a through-hole therein, and the cover means may cover the through-hole. The cover means may extend into the through-hole. The vane member includes a through-hole therein, and further includes a radially inner vortex flow chamber wall portion and a radially outer vortex flow chamber wall portion divided by the through-hole from the vortex flow chamber wall. The vane member may include notches each extending radially inwardly from an outside of the vane member between the vanes adjacent to each other, and the cover means may cover the notches. The cover means may extend into the notches. The through-holes or notches are preferable for increasing a volume on the vortex flow chambers. When cover means extends into the notches or through-holes, an abrupt change of an inner surface of the vortex flow chambers at the notches or through-holes is prevented.

A reverse surface of the vortex flow chamber wall and, a reverse surface of the hub, may form a substantially flat surface plane, and the cover may comprise a substantially flat surface for contacting with the substantially flat surface plane to form the vortex flow chambers together with the vanes and the vortex flow chamber wall as shown in FIGS. 28–30. The cover may further comprise projections on the substantially flat surface so that the projections extend into or fill the notches or through-holes of the vane member to form a smooth inner surface shape of the vortex flow chambers.

The vortex flow chamber wall may have a portion extending in the substantially radial direction of the vane wheel and connecting the vanes adjacent to each other in the substantially circumferential direction of the vane wheel so that the rigidity and strength of the vanes adjacent to each other in the substantially circumferential direction of the vane wheel are improved. The vanes may be prevented from extending over or below the vortex flow chamber wall as seen in the direction substantially parallel to the shaft, so that the casting mold for forming the vane member can be easily and securely supported.

The cover means may have dents receiving the vanes so that the vanes are rigidly supported and by the cover means in a substantially circumferential direction of the vane wheel. The vortex flow blower may further comprises a metal member joined with the vane member and with the cover means so that the cover means is connected to the vane member. The vortex flow blower may further comprises a first metal member joined with the vane member and a second metal member joined with the cover means so that the cover means is connected to the vane member, and an angle between a longitudinal axis of the first metal member and an imaginary plane substantially perpendicular to the output rotational shaft may be different from another angle between a longitudinal axis of the second metal member and the imaginary plane. The cover means may be connected to the shaft independently of the vane member. The cover means and the vane member may have respective surfaces extending substantially parallel to each other to engage with each other.

BRIEF DESCRIPTION OF THE DRAWINGS

FIG. 24(*c*) is a side view of FIG. 24(*b*);

FIG. 24(*d*) is a sectional view along section line (d)—(d) of FIG. 24(*b*);

DETAILED DESCRIPTION

Figure 1:
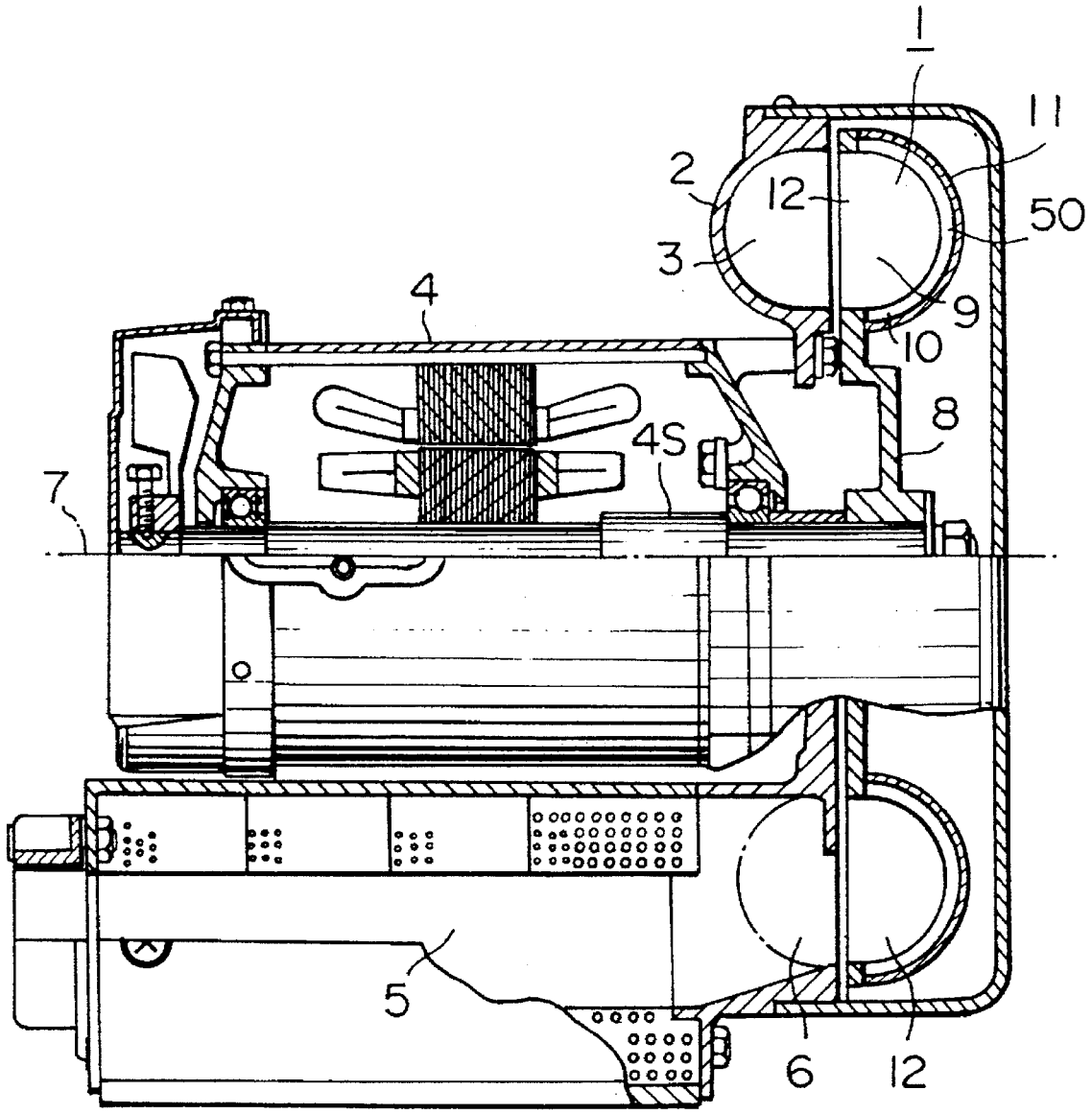
FIG. 1 is a cross-sectional view of a vortex flow blower according to the present invention.
Figure 2:
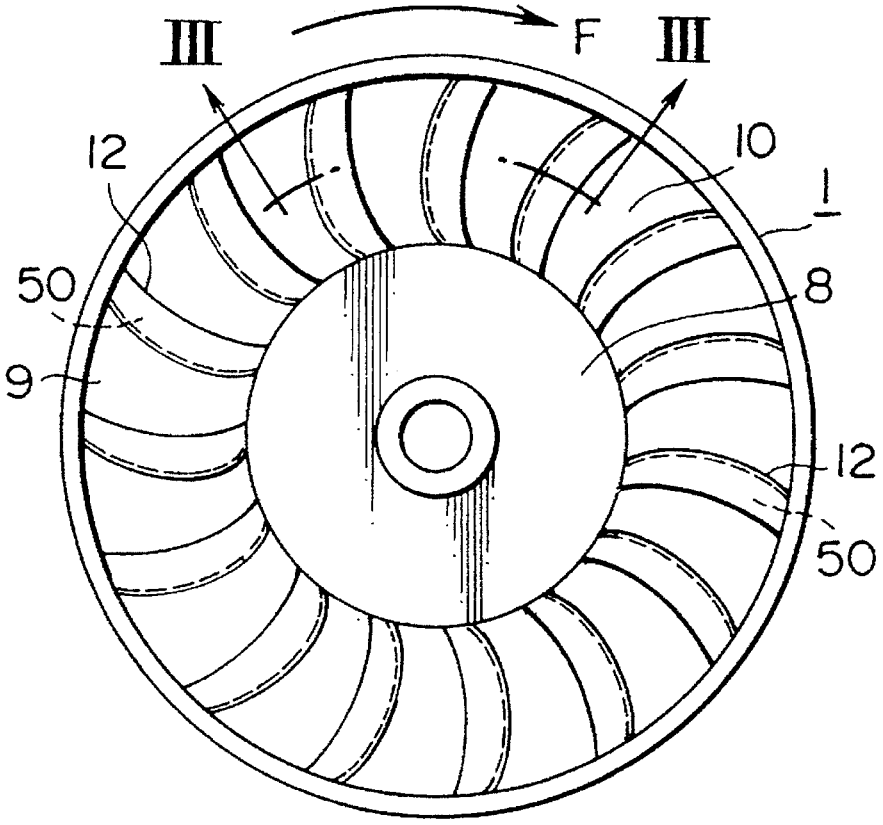
FIG. 2 is a front view of a vane member according to the present invention.
Figure 3:
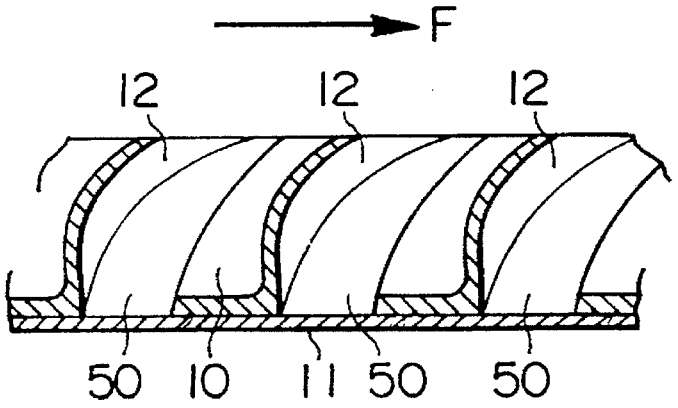
FIG. 3 is a cross-sectional view taken along a line III—III in FIG. 2.
Figure 4:
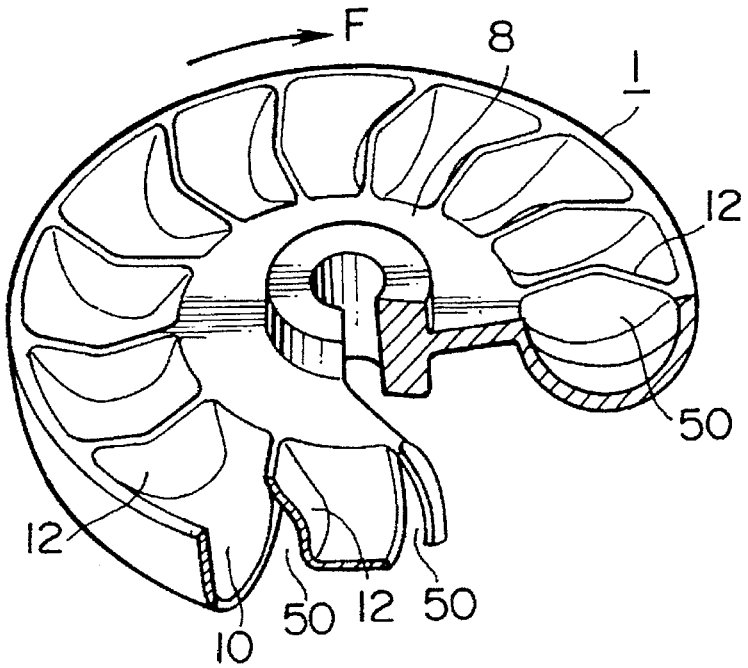
FIG. 4 is a partially cross-sectional schematic view of a vane member according to the present invention.

As shown in FIGS. 1–4 and 8, a vortex flow blower has a vane wheel 1, an electric motor 4 for driving the vane wheel 1, a casing 2 with a pressure increasing passage 3 extending substantially around a rotational shaft axis 7 of the motor 4 and the vane wheel 1 and opening in a direction parallel to the rotational shaft axis 7, an inlet 5 opening at an end of the pressure rising passage 3 to take in air, an outlet (not shown) opening at another end of the pressure increasing passage 3 to discharge the air, and a partition wall 6 arranged between the end and another end of the pressure rising passage 3.

The vane wheel 1 is mounted on an output rotational shaft 4*s* of the motor 4, and includes a hub 8 connected to the output rotational shaft 4*s*, a vortex flow chamber wall 10 for forming vortex flow chambers 9 opening to and along the annular pressure increasing passage 3 in a direction parallel to the rotational shaft axis 7 and partitioned by a plurality of vanes 12 extending substantially radially, and a cover 11 for covering through-holes or notches 50 of the vane wheel 1 at an opposite side of the casing 2. The hub 8, the vanes 12 and the vortex flow chamber wall 10 forming the vane member are made integrally of a light alloy, for example, aluminum, aluminum alloy or the like through a mold process, for example, a die cast molding process.

The vanes 12 project forward in a vane wheel rotational direction to be inclined relative to an imaginary plane perpendicular to the axis 7 so that the air received by the vanes from the inlet 5 is urged strongly toward a wedge-shaped space or bottom of the vane wheel 1 formed by the vanes 12 and the wall 10 and cover 11. The air is accelerated by the vanes 12 in a circumferential direction of the vane wheel 1, and a vortex flow of the air is generated and accelerated in the vortex flow chambers 9. The vortex flow of the air proceeds in the circumferential direction of the vane wheel 1 along an annular passage formed by the pressure increasing passage 3 and the vortex flow chambers 9. Thereafter, the air pressurized, by being accelerated in the circumferential direction of the vane wheel 1 and in a spiral direction of the vortex flow, is discharged from the outlet.

The wall 10 forms the through-holes 50 at the opposite side of the casing 2, and the vanes 12 extend over or below the through-holes 50 as viewed in a direction parallel to the axis 7.

Figure 5:
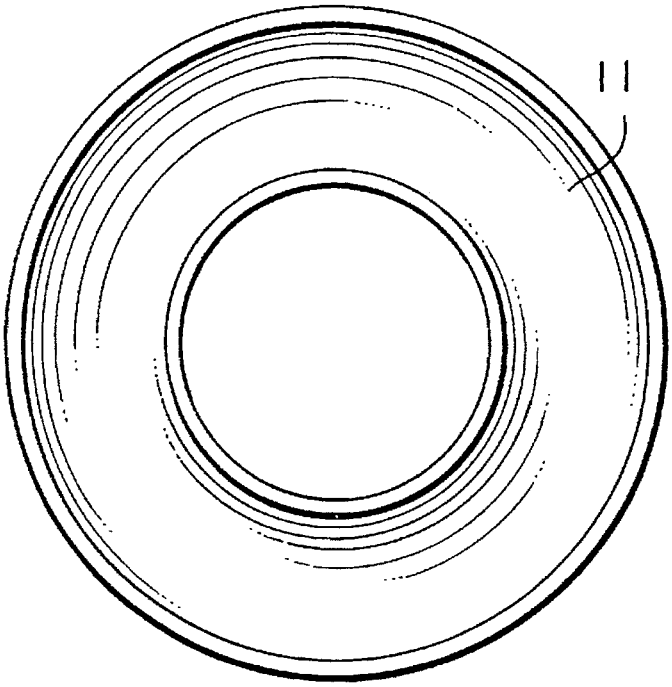
FIG. 5 is a front view of a cover according to the present invention.
Figure 6:
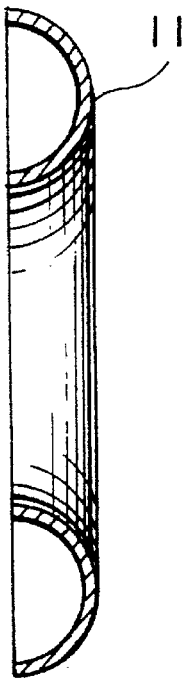
FIG. 6 is a cross-sectional side view of the cover of FIG. 5.

The cover 11 has an inner surface fitting onto a reverse surface of the wall 10 as shown in FIGS. 5 and 6, so that the vane wheel 1 is formed by the cover 11 and an integral or monolithic combination as the claimed vane member of the hub 8, the vanes 12 and the vortex flow chamber wall 10. The cover 11 contacts with the wall 10, preferably with a compression force therebetween. The cover 11 may be divided into a plurality of members each of which contacts with and fits onto the reverse surface of the wall 10, preferably with the compression force therebetween. The cover 11 may be made of steel, aluminum, aluminum alloy or the like, through a press or molding process.

Figure 7:
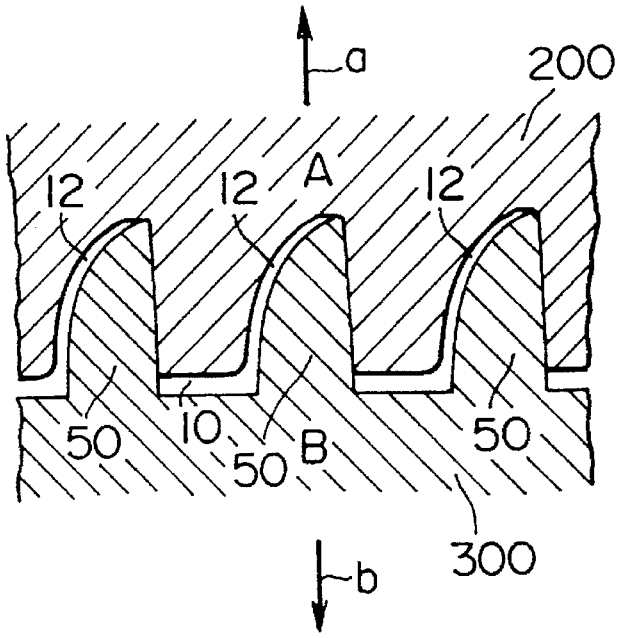
FIG. 7 is a cross-sectional side view showing a combination of upper and lower cast molds for forming vanes, vortex flow chambers and a hub according to the present invention.
Figure 8:
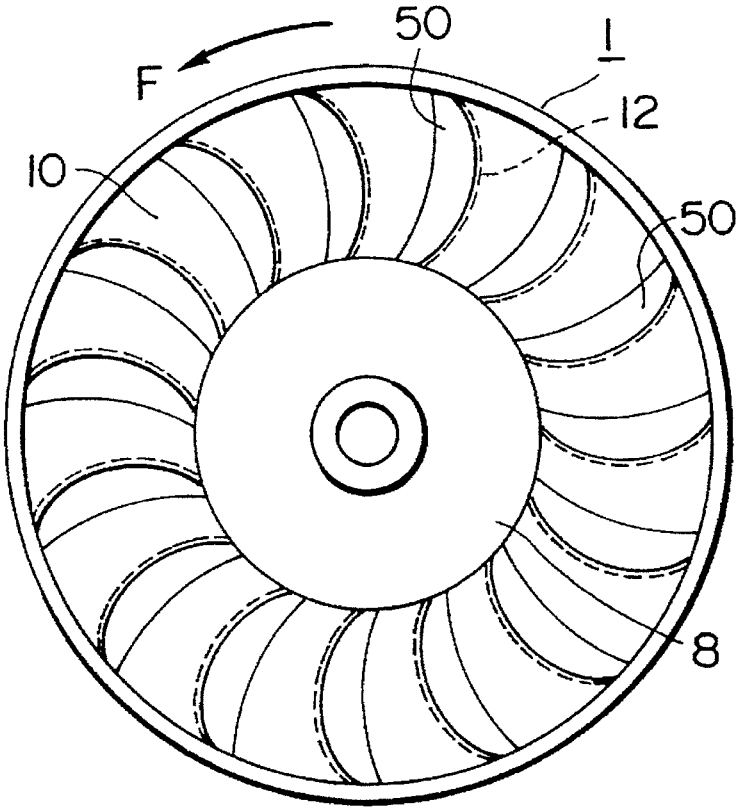
FIG. 8 is a reverse view of a vane member according to the present invention.

As shown in FIG. 7, when an upper mold 200 and a lower mold 300 are combined with each other to integally form integrally the hub 8, the vanes 12 and the vortex flow chamber wall 10, the lower mold 300 for forming the reverse surface of the wall 10 and vanes 12 can extend into an inside of the vane wheel 1 through the through-holes or notches 50, and the combination of the upper mold 200 and lower mold 300 can be disassembled in directions indicated the arrows a and b.

Figure 9:
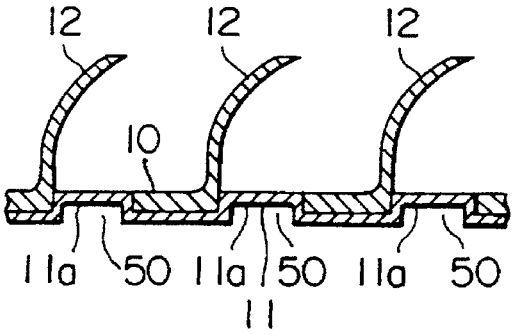
FIG. 9 is a cross-sectional view similar to FIG. 3 of another cover according to the present invention.

As shown in FIG. 9, the cover 11 may have projections 11*a* which extend into the through-holes or notches 50 respectively, and whose upper surfaces form respective parts of semicircle inner surfaces of the vortex flow chambers 9 to prevent an abrupt change of the inner surfaces of the vortex flow chambers 9 at the through-holes or notches 50, so that a smooth air flow is performed in the vortex flow chambers 9.

Figure 10:
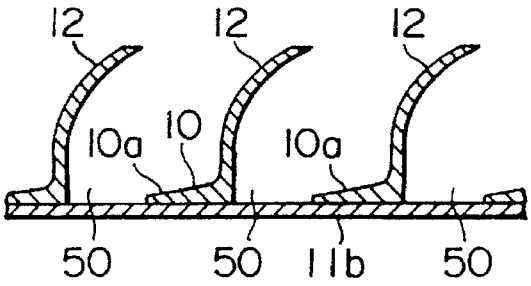
FIG. 10 is a cross-sectional similar to FIG. 3 of another cover according to the present invention.
Figure 11:
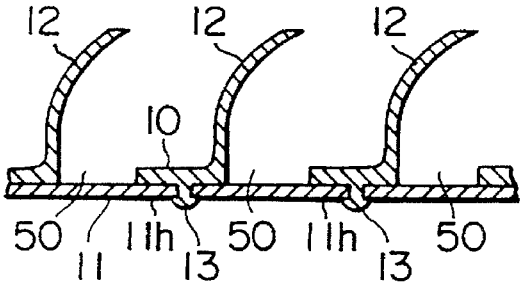
FIG. 11 is a cross-sectional view similar to FIG. 3 of another cover according to the present invention.
Figure 12:
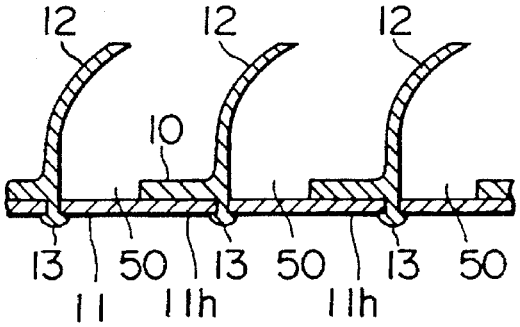
FIG. 12 is a cross-sectional view similar to FIG. 3 of another cover according to the present invention.
Figure 16:
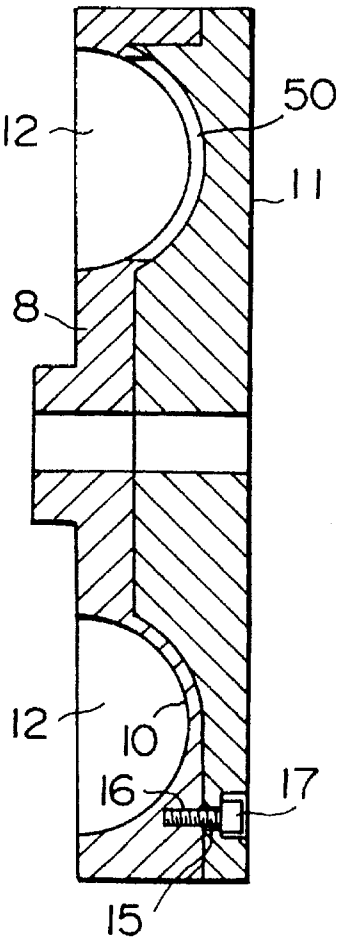
FIG. 16 is a cross-sectional view of another connection between a vane member and a cover according to the present invention.
Figure 15:
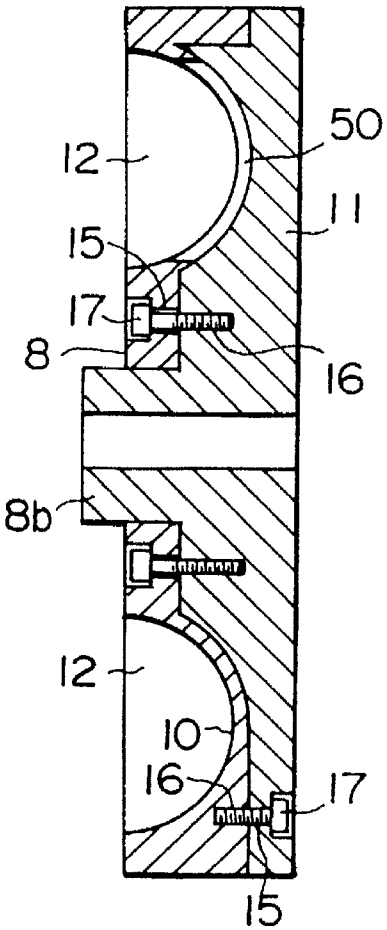
FIG. 15 is a cross-sectional view of another connection between a vane member and a cover according to the present invention.
Figure 14:
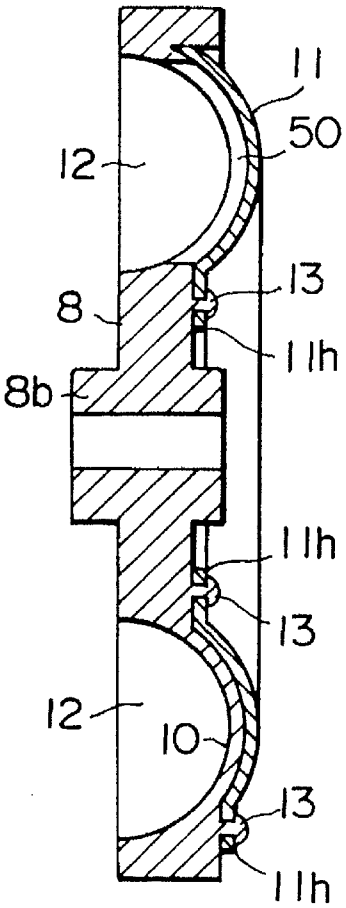
FIG. 14 is a cross-sectional view of another connection between a vane member and a cover according to the present invention.
Figure 13:
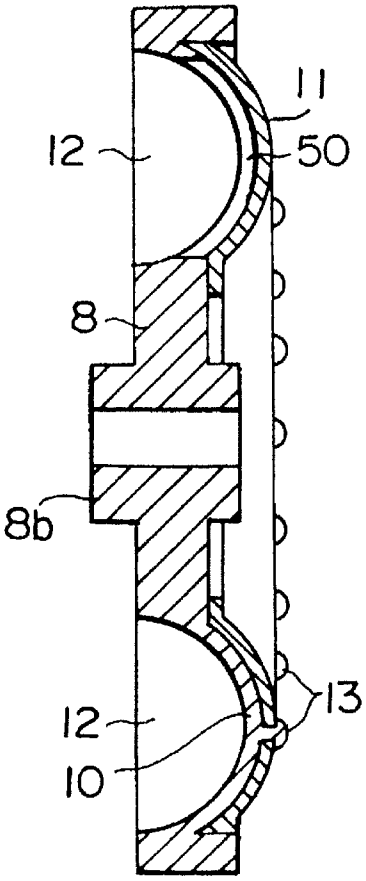
FIG. 13 is a cross-sectional view of a connection between a vane member and a cover according to the present invention.
Figure 18A:
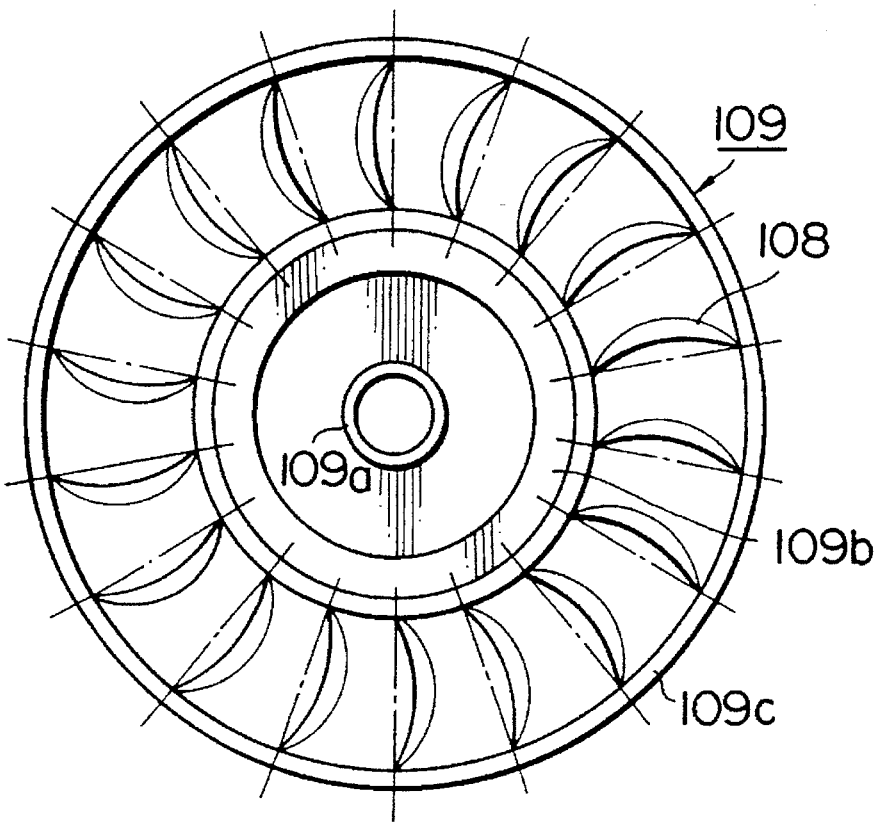
FIG. 18*a* is a front view of another vane member according to the present invention.
Figure 18C:
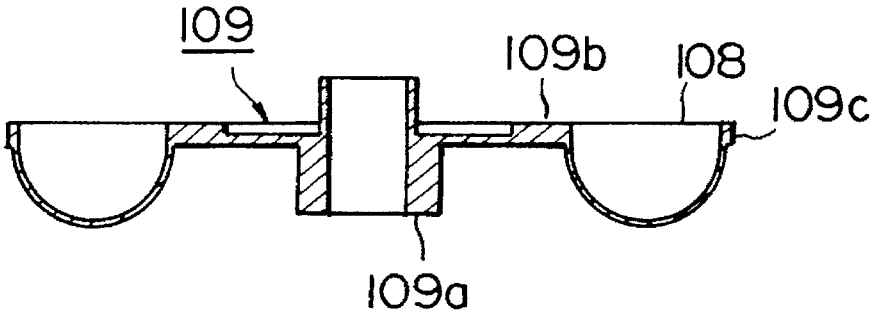
FIG. 18*c* is a cross-sectional view of the vane member of FIG. 18*a*.
Figure 18B:
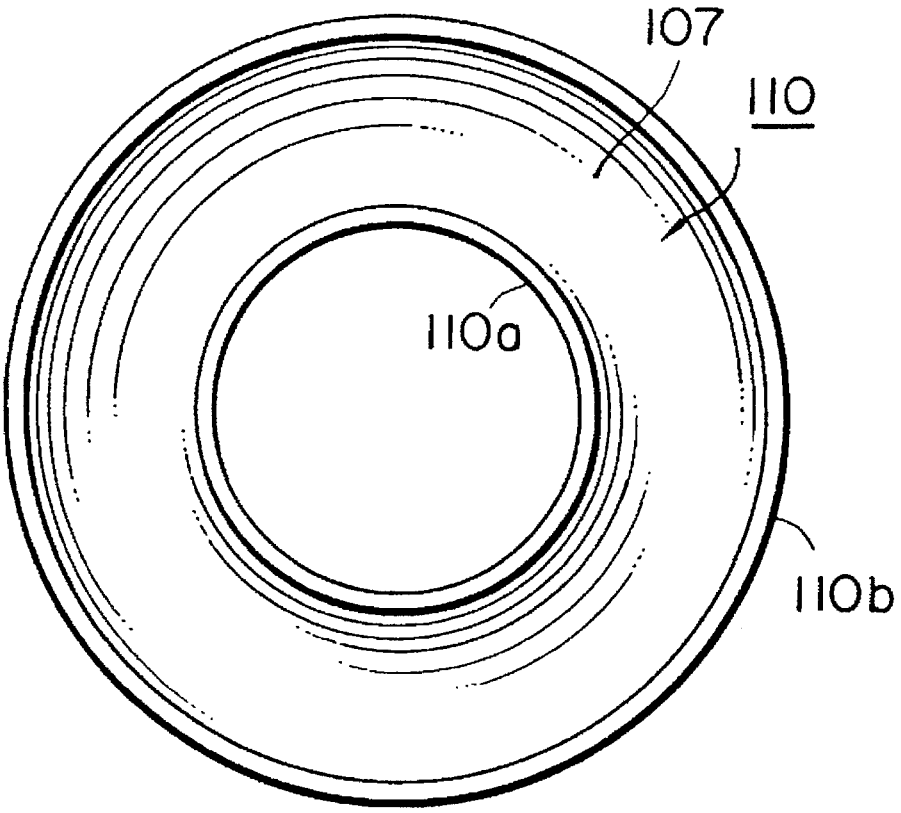
FIG. 18*b* is a front view of another cover according to the present invention.
Figure 18D:
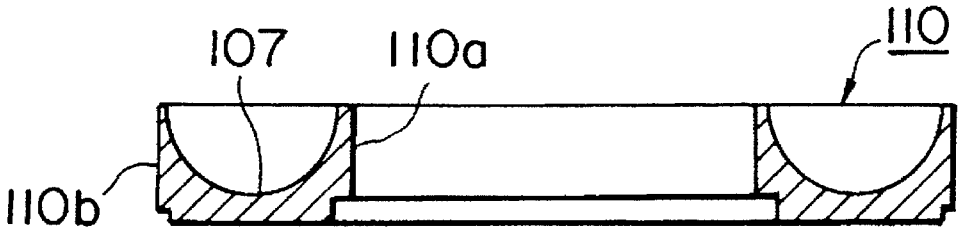
FIG. 18*d* is a cross-sectional view of the cover of FIG. 18*b*.

As shown in FIG. 10, the vortex flow chamber wall 10 may be tapered to prevent the abrupt change of the inner surfaces of the vortex flow chambers 9 at boundaries between an edge of the wall 10 and the through-holes or notches 50, so that the smooth air flow is performed in the vortex flow chambers 9. As shown in FIG. 11, the vortex flow chamber wall 10 may have projections 13 and the cover 11 may have holes 11*h* so that the cover 11 is pressed against and fixed to the wall 10 to form the vane wheel 1 after forward ends of the projections 13 are plastically deformed or caulked. As shown in FIG. 12, the projections 13 may be arranged on the vanes 12. As shown in FIG. 13, it is not necessary for combinations of the projections 13 and the holes 11*h* to be arranged at every vortex flow chambers 9. As shown in FIG. 14, the projections 13 may be arranged on the hub 8. As shown in FIG. 15, the cover 11 may be pressed against and fixed to the integral combination of the hub 8, the vanes 12 and the vortex flow chamber wall 10 by bolts 17 extending through bolt apertures 15 and bolt accomodating holes 16. In this embodiment, the hub 8 is connected to the shaft 4s through a boss 8b included in the cover 11. As shown in FIG. 16, the integral combination of the hub 8, the vanes 12 and the vortex flow chamber wall 10 may be connected to the shaft 4*s* through the hub 8, and the cover 11 may be directly connected to the shaft 4*s*.

Figure 17:
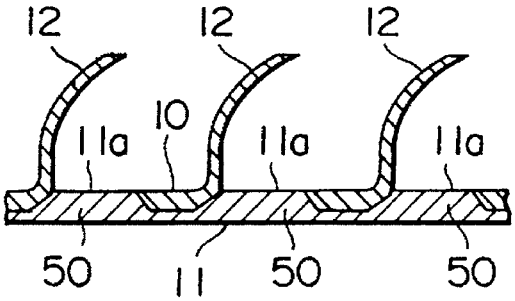
FIG. 17 is a cross-sectional view of another cover according to the present invention.

As shown in FIG. 17, the vortex flow chamber wall 10 and the cover 11 may have wedge-shaped taper projections and dents engage tightly with each other so that a hermetical seal is formed therebetween to prevent water from penetrating therebetween. It is preferable for the integral assembly of the hub 8, the vanes 12 and the vortex flow chamber wall 10 and the cover to be made of a common material to prevent a contact corrosion between different materials. If a material of the integral assembly and a material of the cover 11 are different from each other, it is preferable that an electric potential difference between the materials is small and an electrically insulating varnish of, for example, polyester type or epoxy type is arranged between the integral assembly and the cover 11. The integral or monolithic combination of the hub 8, the vanes 12 and the vortex flow chamber wall 10 may contact the cover 11 through an adhesive therebetween for fixing the cover 11 to the monolithic combination.

Figure 19A:
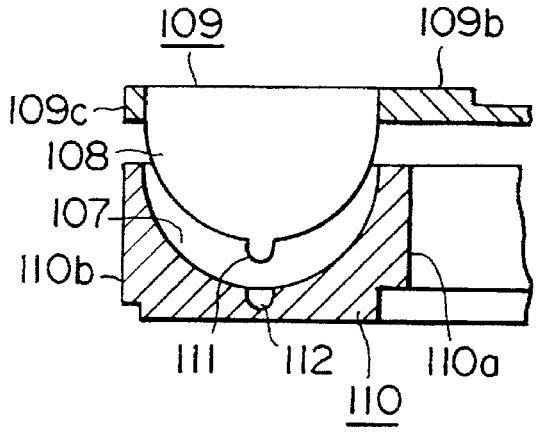
FIG. 19*a* is a cross-sectional view of an engagement between a vane member and a cover according to the present invention.
Figure 19B:
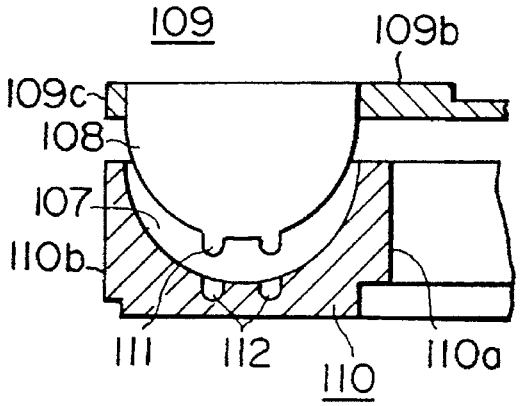
FIG. 19*b* is a cross-sectional view of another engagement between a vane member and a cover according to the present invention.
Figure 20:
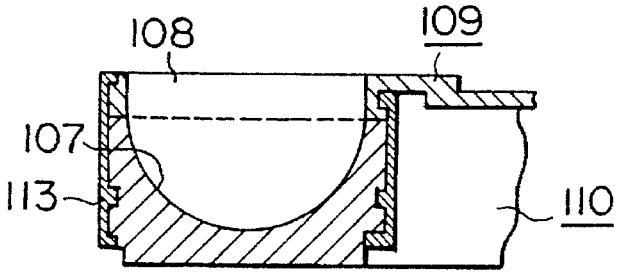
FIG. 20 is a cross-sectional view of another connection between a vane member and a cover according to the present invention.

As shown in FIGS. 18*a*–18*d*, the vane wheel 1 may be composed of an integral or monolithic combination 109 as the vane member of a boss 109*a*, a hub 109*b*, vanes 108 and an outer limb 109*c*, and an integral or monolithic combination 110 as the cover means of an inner cylindrical portion 110*a*, a vortex flow groove wall 107 forming an annular vortex flow groove 17 and an outer cylindrical portion 110*b*. As shown in FIGS. 19*a* and 19*b*, the vanes 108 are fitted into the annular vortex flow groove 17 so that the annular vortex flow groove 17 is divided by the vanes 108 to form the vortex flow chambers 9. Each of the vanes 108 has at least one projection 111 fitted into at least one dent or radially extending groove 112 formed on the annular vortex flow groove 17 so that the vanes 108 is rigidly and strongly supported in the circumferential direction of the vane wheel 1 against an air pressure. The integral combinations 109 and 110 are fixedly joined with a cast portion 113 which is formed by utilizing the integral combinations 109 and 110 as a mold core.

Figure 21A:
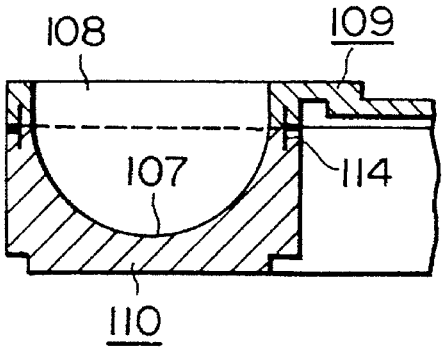
FIG. 21*a* is a cross-sectional view of another connection between a vane member and a cover according to the present invention.
Figure 21B:
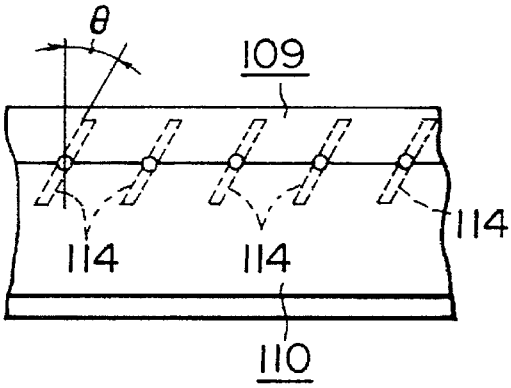
FIG. 21*b* is a partial side view of the another connection of FIG. 21*a*.
Figure 22A:
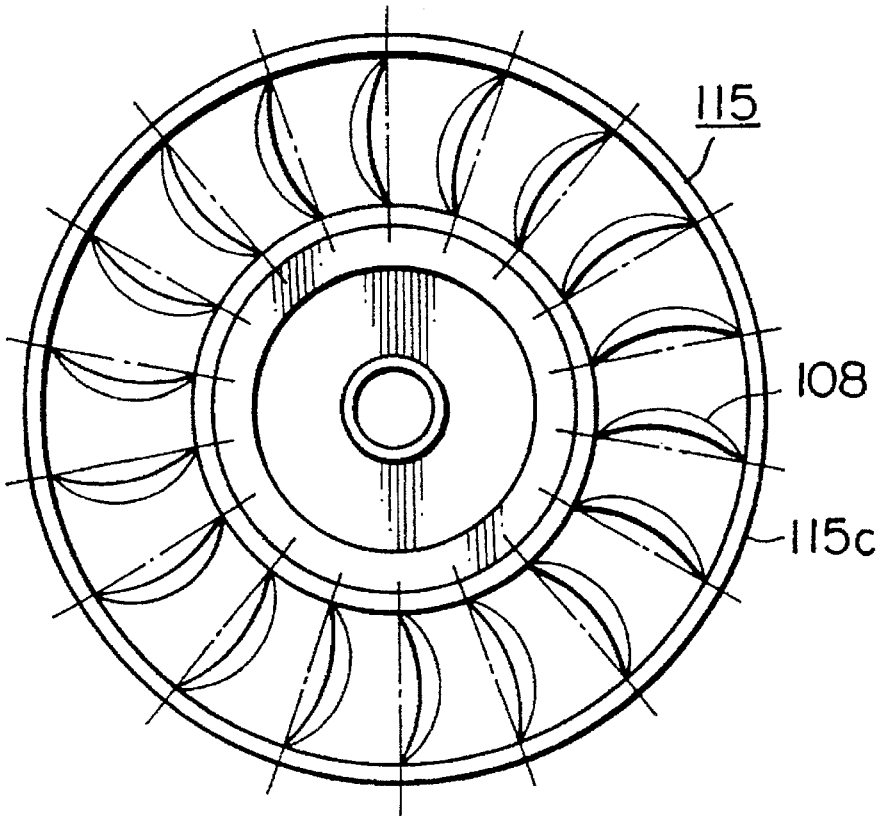
FIG. 22*a* is a front view of another vane member according to the present invention.
Figure 22C:
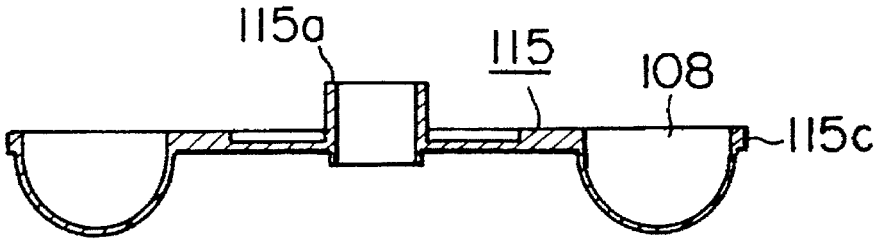
FIG. 22*c* is a cross-sectional view of the another vane member of FIG. 22*a*.
Figure 22B:
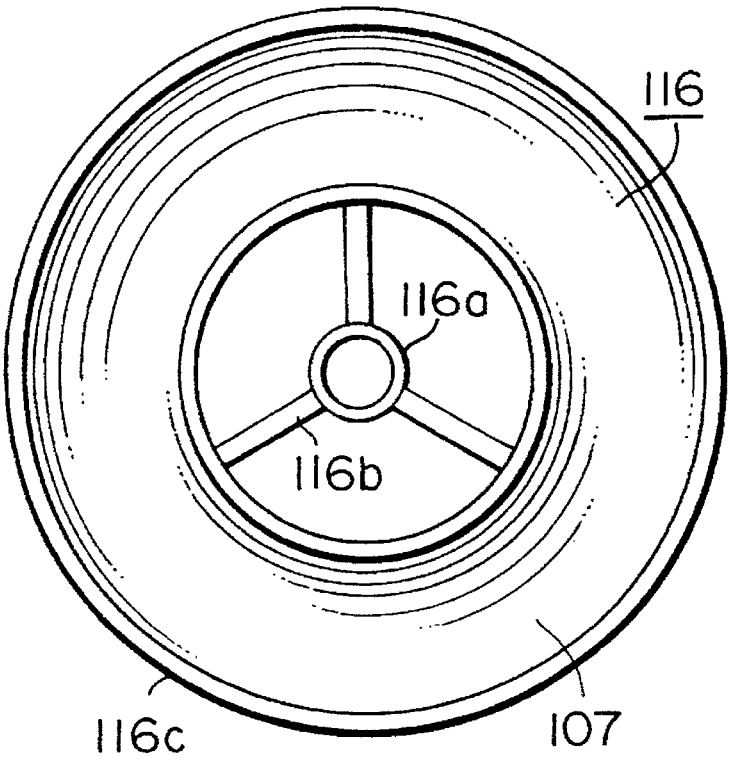
FIG. 22*b* is a front view of another cover according to the present invention.
Figure 22D:
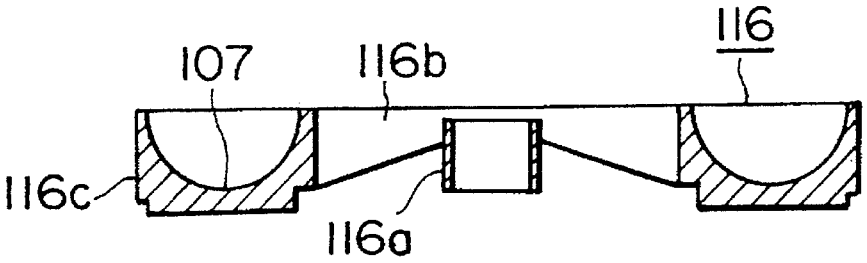
FIG. 22*d* is a cross-sectional view of the another cover of FIG. 22*b*.
Figure 23A:
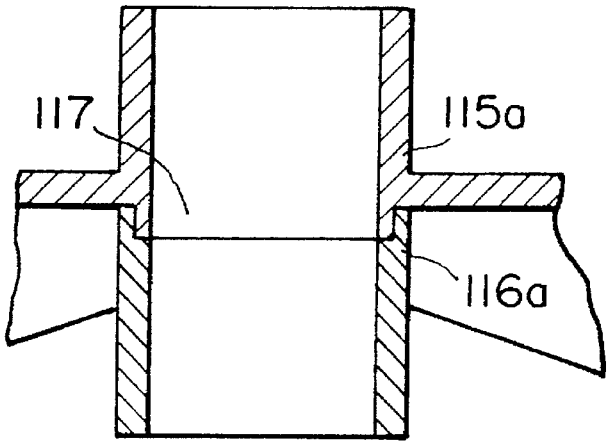
FIG. 23*a* is a cross-sectional view of another connection between a vane member and a cover around a driving shaft according to the present invention.
Figure 23B:
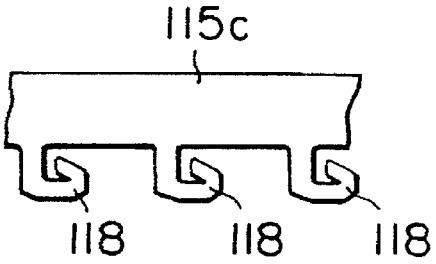
FIG. 23*b* is a side view of engaging projections of a vane member according to the present invention.
Figure 23C:
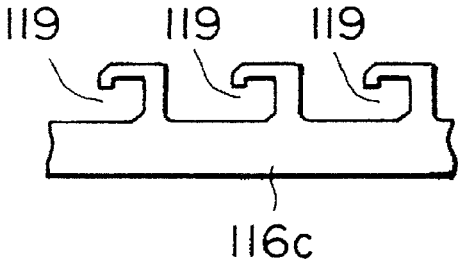
FIG. 23*c* is a side view of engaging dents of a cover according to the present invention.
Figure 23D:
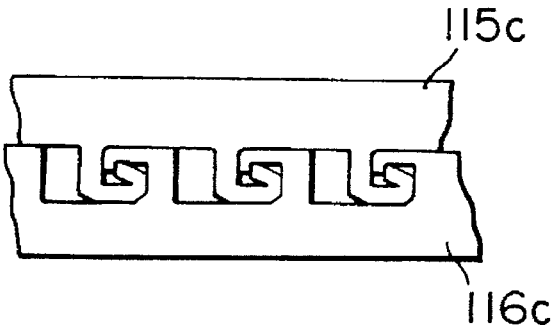
FIG. 23*d* is a side view of an engagement between the projections and dents shown in FIGS. 23*b* and 23*c*.
Figure 24A:
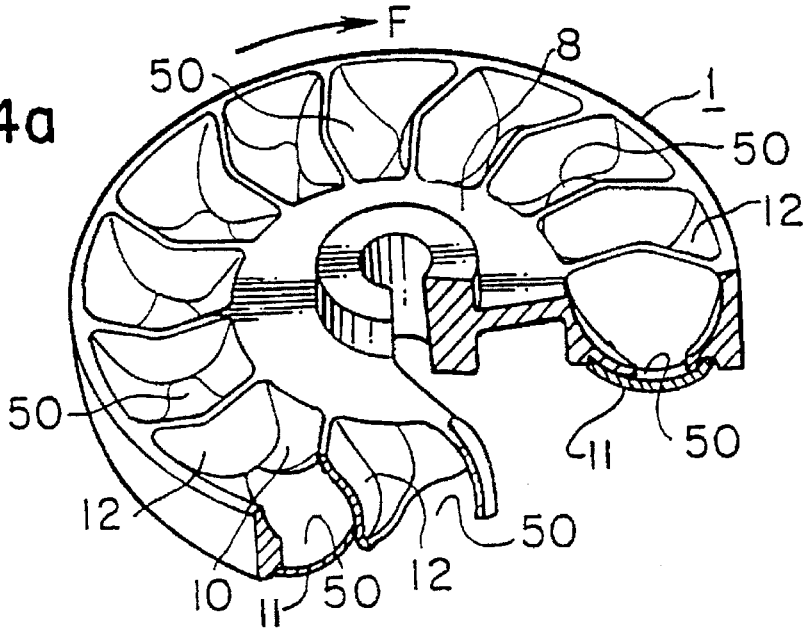
FIG. 24A is a partially cross-sectional schematic view of another vane member with a curved vortex flow chamber wall extending radially inwardly and outwardly and with through-holes terminating at vanes to divide the vortex flow chamber wall into radially inner and outer portions, according to the present invention.
Figure 24B:
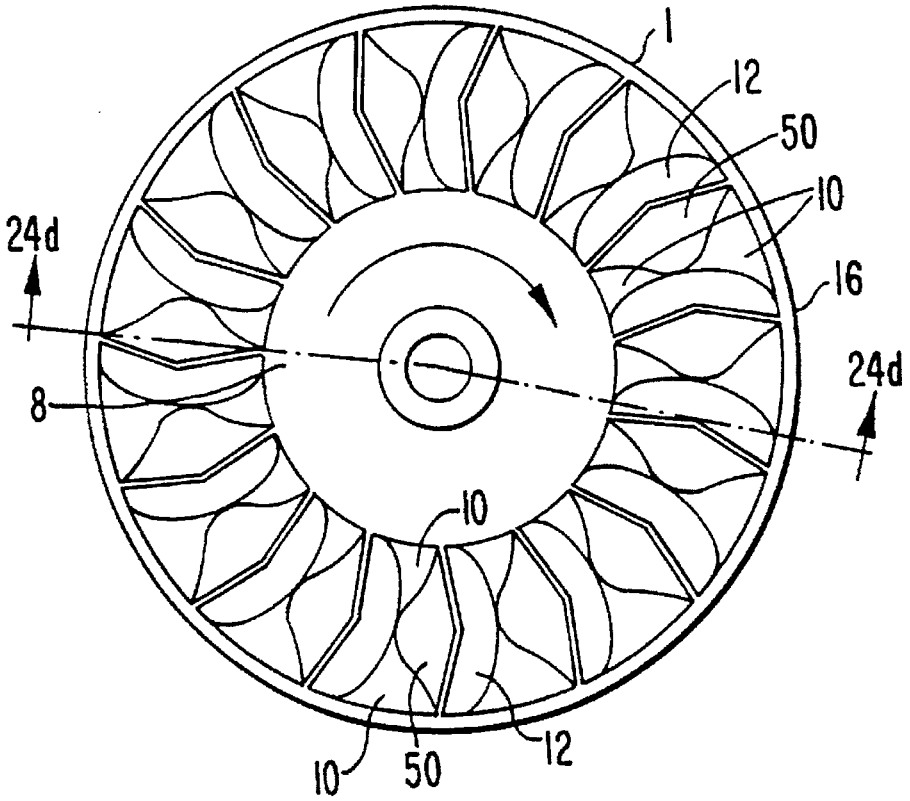
FIG. 24(*b*) is a top view of a vane member in accordance with FIG. 24(*a*)
Figure 24C:
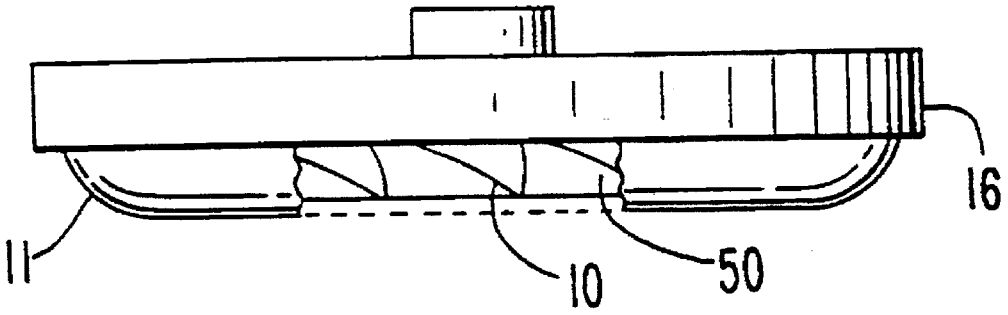
Figure 24D:
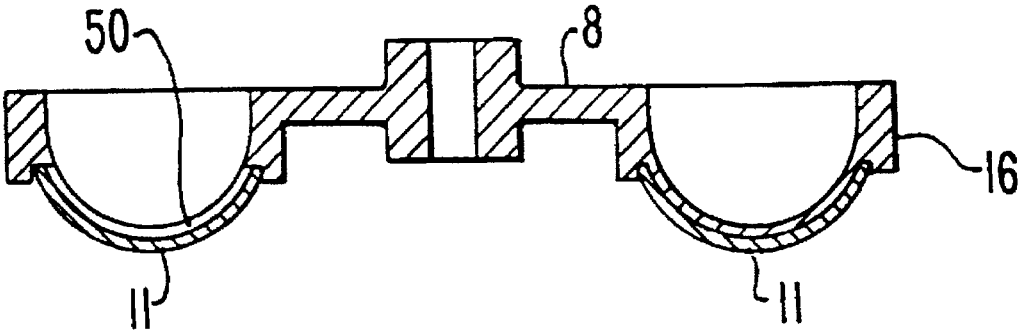

As shown in FIGS. 21*a* and 21*b*, the integral combinations 109 and 110 are fixedly joined with casted portions 114 which are formed by inserting a melted metal into aligned grooves in the combinations 109 and 110. Preferably for strong fixing an inclined direction of angle θ of the cast portions 114 at a radially outer side of the vane wheel 1 is reverse to that of the cast portions 114 at a radially inner side thereof.

As shown in FIGS. 22*a*–23*d*, the vane wheel 1 may be composed of an integral or monolithic combination 115 as the vane member of a hub 115*a* mounted on the shaft 4*s*, the vanes 108 and an outer limb 115*c*, and an integral or monolithic combination 116 with the cover means of a boss 116*a* mounted on the shaft 4*s*, inner ribs 116*b*, the vortex flow groove wall 107 and an outer cylindrical portion 116*c*. The hub 115*a* may be fitted into the boss 116*a* around the shaft 4*s*. The outer limb 115*c* and the outer cylindrical portion 116*c* may have projections 118 and dents 119 engaged with each other by rotating the limb 115*c* relative to the cylindrical portion 116*c* as shown by an arrow R. This structure is appropriate when the monolithic combinations 115 and 116 to be fixed to each other are made of a plastic resin.

Figure 25:
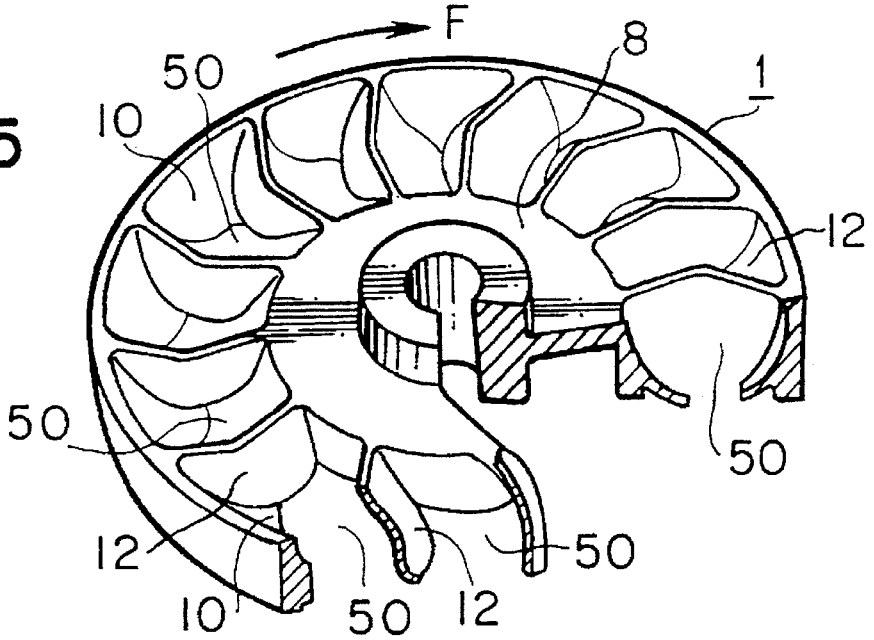
FIG. 25 is a partial cross-sectional schematic view of another vane member with a curved vortex flow chamber wall extending radially inwardly and with through-holes in the vortex flow chamber wall, according to the present invention.
Figure 26:
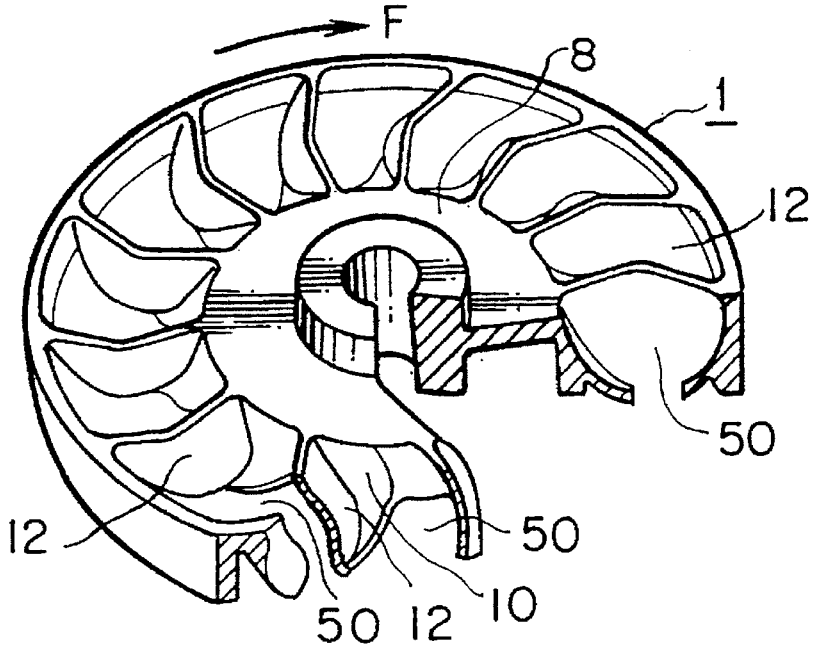
FIG. 26 is a partial cross-sectional schematic view of another vane member with a curved vortex flow chamber wall extending radially outwardly and with through-holes in the vortex flow chamber wall, according to the present invention.
Figure 27:
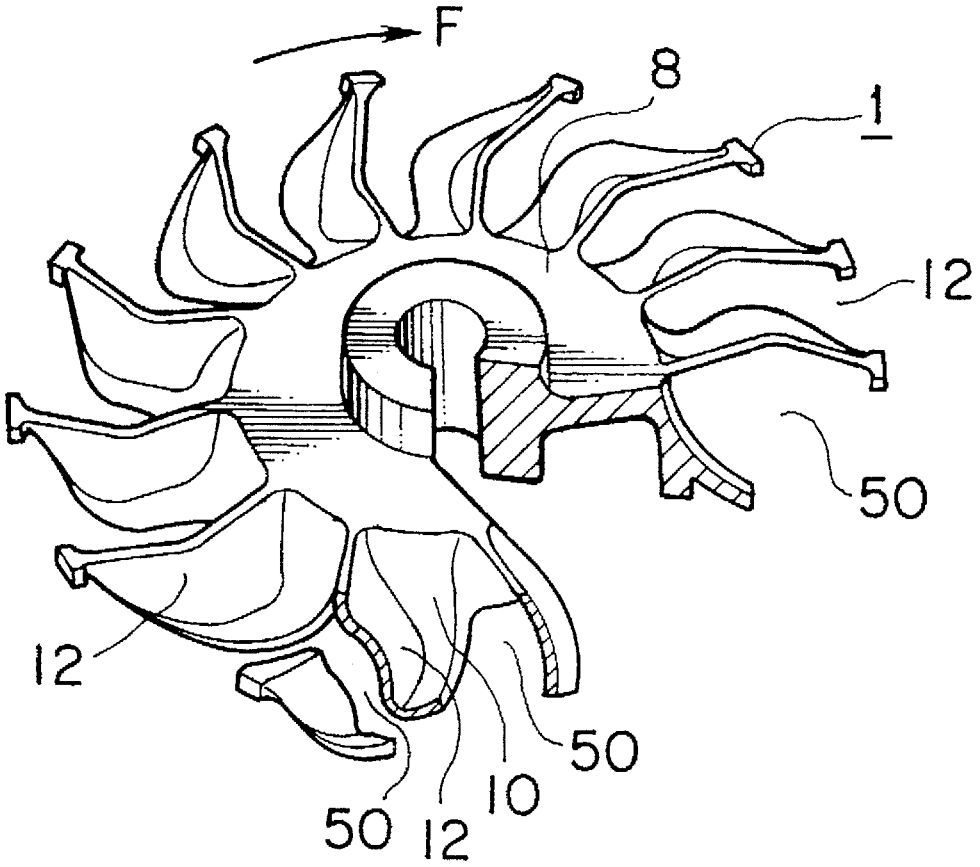
FIG. 27 is a partial cross-sectional schematic view showing another vane member with a curved vortex flow chamber wall extending radially outwardly and with notches extending inwardly from an outside of the vane member.

As shown in FIGS. 24–26, the vortex flow chamber wall 10, curved to extend radially and forming the through-holes or notches 50, may have a radially inner extension length different from a radially outer extension length. FIGS. 24(*a*)–(*d*) illustrate another vane member in accordance with the invention with FIG. 24(*a*) being a partial sectional view, FIG. 24(*b*) being a top view, FIG. 24(*c*) being a side view and FIG. 24(*d*) being a sectional view of FIG. 24(*b*) along section line d—d. The cover 11 is spaced from the flow chamber wall 10. The through-holes or, notches 50 may be surrounded by the wall 10, or, alternatively, may terminate at the vanes 12. As shown in FIG. 27, the notches 50 may extend radially inwardly from an outside of the vane wheel 1 to the vortex flow chamber wall 10.

Figure 28:
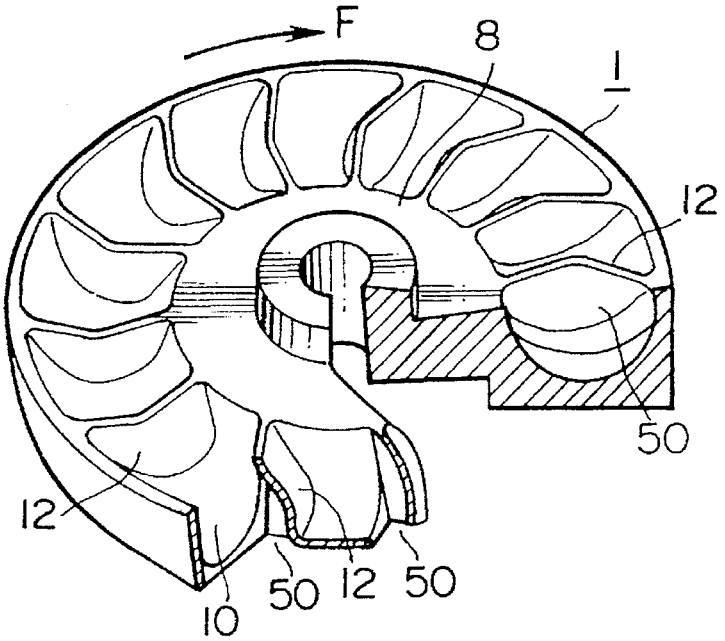
FIG. 28 is a partial cross-sectional schematic view showing another vane member.
Figure 29:
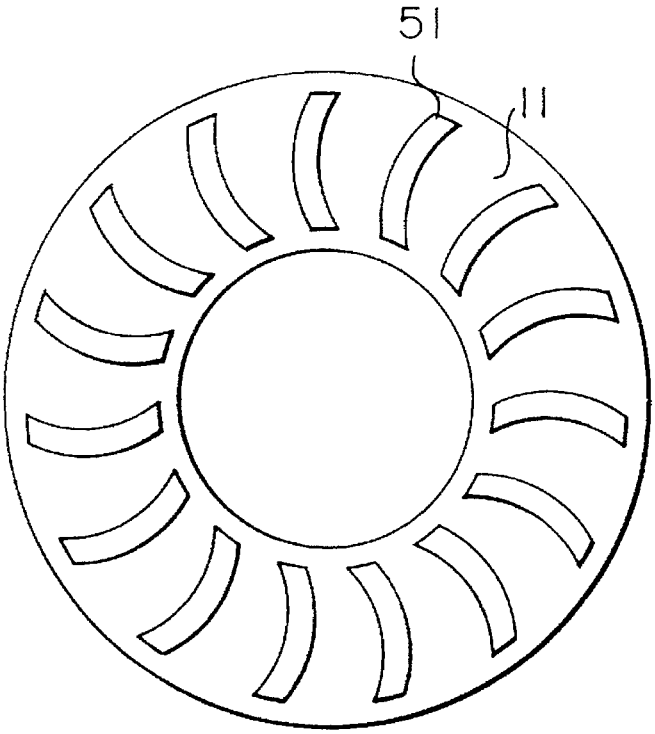
FIGS. 29 and 30 are front and side-cross-sectional views of cover for the another vane member of FIG. 28.
Figure 30:
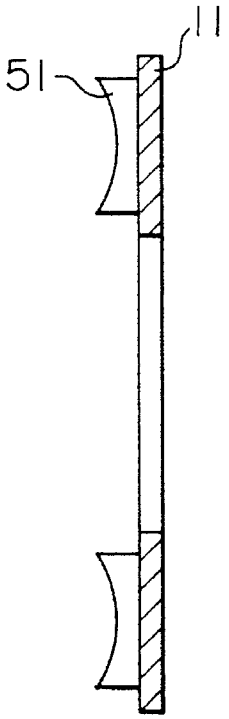

As shown in FIG. 28, the wall 10 may have an annular planar reverse surface. The annular planar reverse surface is covered by the cover 11, which includes a planar surface for contacting with the annular planar reverse surface as shown in FIGS. 29 and 30. The cover 11 may have projections 51 extending into or filling the through-holes 50 to form a smooth inner surface of the vortex flow chambers together with the vanes 12 and the vortex flow chamber wall 10.

What is claimed is:

1. A vane wheel driven by a shaft for transferring a gas, comprising, vortex flow chambers opening in a direction substantially parallel to the shaft to receive the gas, to urge the gas in a substantially circumferential direction of the vane wheel, and to generate and accelerate a vortex flow of the gas, a vane member has a hub through which the vane member is connected to the shaft, a plurality of vanes each of which extends integrally from the hub in a substantially radial direction of the vane wheel and includes a front surface for urging the gas in the substantially circumferential direction of the vane wheel, and a vortex flow chamber wall extending integrally from both of the hub and each of the vanes, and a cover means contacting with the vortex flow chamber wall to form the vortex flow chambers together with the vortex flow chamber wall and the vanes.

2. A vortex flow blower for transferring gas, comprising a motor having an output rotational shaft, and a vane wheel driven by the shaft, wherein the vane wheel comprises:

vortex flow chambers opening in a direction substantially parallel to the shaft to receive the gas therein, to urge the gas therein in a substantially circumferential direction of the vane wheel, and to generate and accelerate a vortex flow of gas therein:

a vane member having a hub through which the vane member is connected to the shaft, and a plurality of vanes each of which extends integrally from the hub in a substantially radial direction of the vane wheel for urging the gas in the substantially circumferential direction of the vane wheel; and a cover means connected to the vane member for forming the vortex flow chambers together with the vanes.

3. A vortex flow blower according to claim 2, wherein the cover means has dents receiving the vanes so that the vanes are supported by the cover means in the substantially circumferential direction of the vane wheel.

4. A vortex flow blower according to claim 2, further comprising a metal member joined with the vane member and with the cover means so that the cover means is connected to the vane member.

5. A vortex flow blower according to claim 2, further comprising a first metal member joined with the vane member and a second metal member joined with the cover means so that the cover means is connected to the vane member, wherein an angle between a longitudinal axis of the first metal member and an imaginary plane substantially perpendicular to the output rotational shaft is different from another angle between a longitudinal axis of the second metal member and the imaginary plane.

6. A vortex flow blower according to claim 2, wherein the cover means is connected to the shaft independently of the vane member.

7. A vortex flow blower according to claim 2, wherein the cover means and the vane member have respective surfaces extending substantially parallel to each other to engage with each other.

* * * * *